US009886000B2

(12) United States Patent
Kato et al.

(10) Patent No.: US 9,886,000 B2
(45) Date of Patent: Feb. 6, 2018

(54) IMAGE FORMING APPARATUS AND FIXING DEVICE CONTROLLER

(71) Applicant: FUJI XEROX CO., LTD., Tokyo (JP)

(72) Inventors: Yasuhiro Kato, Kanagawa (JP); Hideki Sato, Kanagawa (JP); Jun Sawamura, Kanagawa (JP); Yoshiro Konishi, Kanagawa (JP); Masahiro Akatsuka, Kanagawa (JP); Takayuki Ukawa, Kanagawa (JP); Yusuke Sakurai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/251,010

(22) Filed: Aug. 30, 2016

(65) Prior Publication Data

US 2017/0261922 A1 Sep. 14, 2017

(30) Foreign Application Priority Data

Mar. 8, 2016 (JP) ..... 2016-044125

(51) Int. Cl.
*G03G 21/16* (2006.01)

(52) U.S. Cl.
CPC ..... *G03G 21/1685* (2013.01)

(58) Field of Classification Search
CPC ..... G03G 21/1685; G03G 15/2035; G03G 15/2067; G03G 15/2071
See application file for complete search history.

(56) References Cited

U.S. PATENT DOCUMENTS

2009/0060571 A1* 3/2009 Kang ..... G03G 21/1685 399/122
2009/0232550 A1* 9/2009 Obata ..... G03G 21/1685 399/122
2014/0294415 A1* 10/2014 Maruta ..... G03G 15/80 399/67

FOREIGN PATENT DOCUMENTS

JP 2008-192580 A 8/2008
JP 2010-2764 A 1/2010

* cited by examiner

*Primary Examiner* — Victor Verbitsky
(74) *Attorney, Agent, or Firm* — Sughrue Mion, PLLC

(57) ABSTRACT

An image forming apparatus includes a fixing device that includes a pressing unit and a heating unit provided facing the pressing unit, an image-forming-apparatus body in which the fixing device is housed and to and from which the fixing device is attachable and detachable, a fixing-device-attachment-detachment-detecting member that detects attachment or detachment of the fixing device to or from the image-forming-apparatus body, and a controller that controls, if the fixing-device-attachment-detachment-detecting member detects the detachment of the fixing device from the image-forming-apparatus body, the image-forming-apparatus body to take a position where the pressing unit and the heating unit are to be pressed against each other.

7 Claims, 7 Drawing Sheets

IMAGE FORMING APPARATUS AND FIXING DEVICE CONTROLLER

CROSS-REFERENCE TO RELATED APPLICATIONS

This application is based on and claims priority under 35 USC 119 from Japanese Patent Application No. 2016-044125 filed Mar. 8, 2016.

BACKGROUND

Technical Field

The present invention relates to an image forming apparatus.

SUMMARY

According to an aspect of the invention, there is provided an image forming apparatus including a fixing device that includes a pressing unit and a heating unit provided facing the pressing unit, an image-forming-apparatus body in which the fixing device is housed and to and from which the fixing device is attachable and detachable, a fixing-device-attachment-detachment-detecting member that detects attachment or detachment of the fixing device to or from the image-forming-apparatus body, and a controller that controls, if the fixing-device-attachment-detachment-detecting member detects the detachment of the fixing device from the image-forming-apparatus body, the image-forming-apparatus body to take a position where the pressing unit and the heating unit are to be pressed against each other.

BRIEF DESCRIPTION OF THE DRAWINGS

An exemplary embodiment of the present invention will be described in detail based on the following figures, wherein.

DETAILED DESCRIPTION

Figure 1:
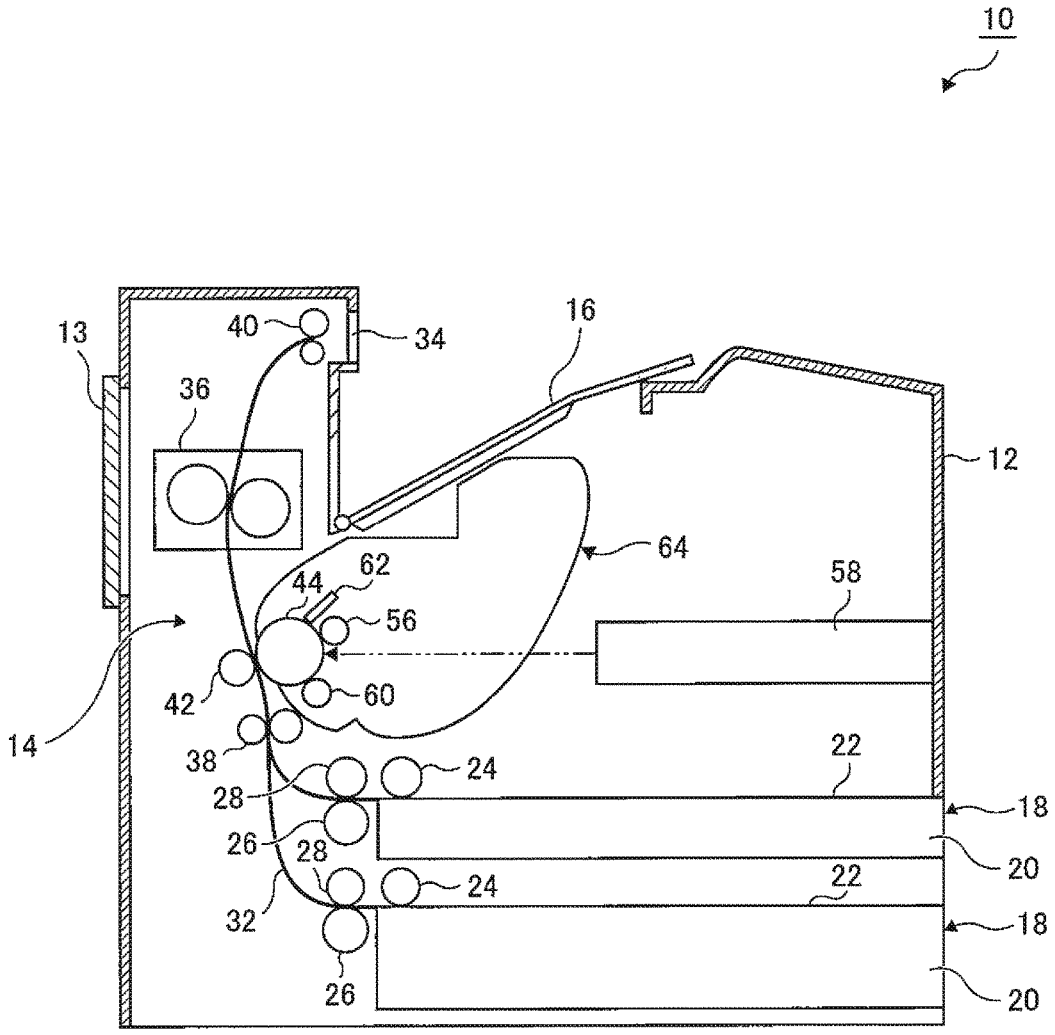
FIG. 1 is a side sectional view of an image forming apparatus according to the exemplary embodiment.

Referring to FIGS. 1 to 7B, an image forming apparatus 10 according to an exemplary embodiment of the present invention will now be described. As illustrated in FIG. 1, then image forming apparatus 10 according to the present exemplary embodiment includes an image-forming-apparatus body 12, in which at least one sheet-feeding unit 18, an image forming unit 14, and a fixing device 36 are provided. The image-forming-apparatus body 12 has, at the top thereof, an output port 34. A transport path 32 along which a recording medium 130, which is a transfer object such as recording paper, is transported extends in such a manner as to connect the sheet-feeding unit 18, the image forming unit 14, the fixing device 36, and the output port 34. The image-forming-apparatus body 12 has a covering member 13 that is opened or closed when the fixing device 36 is attached to or detached from the image-forming-apparatus body 12. A controller 170 that controls various operations is provided in the image-forming-apparatus body 12 (see FIG. 3). The image forming apparatus 10 according to the present exemplary embodiment is capable of printing on different kinds of recording media 130, including a recording medium 130 for normal printing, and an envelope. Details of the above elements will further be described.

The sheet-feeding unit 18 includes a sheet-feeding-unit body 20, a sheet cassette 22 that contains recording media 130 as transfer objects, a pickup roller 24 that picks up some of the recording media 130 stacked in the sheet cassette 22, and a pair of a feed roller 28 and a retard roller 26 that separate one of the picked recording media 130 from the others and feed the recording medium 130 into the transport path 32. With the rotation of the pickup roller 24, the feed roller 28, and the retard roller 26, the recording media 130 stacked in the sheet cassette 22 are each transported along the transport path 32 to a pair of registration rollers 38 to be described later. The sheet cassette 22 is detachably attached to the sheet-feeding-unit body 20. The image forming apparatus 10 includes at least one sheet-feeding unit 18. That is, the image forming apparatus 10 may include plural sheet-feeding units 18. In the present exemplary embodiment, the image forming apparatus 10 includes two sheet-feeding units 18 as illustrated in FIG. 1.

The image forming unit 14 employs an electrophotographic method and includes an image carrier 44 as a photosensitive member, a charging device 56 provided in the form of a charging roller or the like and that uniformly charges the image carrier 44, an optical drawing device 58 that draws a latent image with light on the image carrier 44 charged by the charging device 56, a developing device 60 including a developing roller for visualizing the latent image formed on the image carrier 44 by the optical drawing device 58 into a toner image by using toner, a transfer device 42 provided in the form of a transfer roller or the like and transfers the toner image developed by the developing device 60 to the recording medium 130, a cleaning device 62 that removes residual toner particles from the image carrier 44, and the fixing device 36 that fixes the toner image transferred to the recording medium 130 by the transfer device 42 on the recording medium 130.

The optical drawing device 58 is, for example, a scanning laser exposure device and forms a latent image on the image carrier 44 while moving along a process cartridge 64 to be described later. The optical drawing device 58 may alternatively be a light-emitting diode (LED), a surface-emission laser, or the like.

The process cartridge 64 is a unit including the image carrier 44, the charging device 56, the developing device 60, and the cleaning device 62 and is interchangeable as the unit.

The transport path 32 is a passageway for the recording medium 130 and extends from the pickup roller 24 of the sheet-feeding unit 18 at the bottom of the image-forming-apparatus body 12 to the output port 34 at the top of the image-forming-apparatus body 12. A portion of the transport path 32 in the image-forming-apparatus body 12 extends substantially vertically from the pickup roller 24 of the sheet-feeding unit 18 at the bottom to the fixing device 36.

The transfer device 42 and the image carrier 44 are provided on the upstream side of the fixing device 36 on the transport path 32, and the pair of registration rollers 38 are provided on the upstream side of the transfer device 42 and the image carrier 44 on the transport path 32. Furthermore, a pair of discharge rollers 40 are provided on the transport path 32 near the output port 34.

Hence, one of the recording media 130 picked up from the sheet cassette 22 of the sheet-feeding unit 18 by the pickup roller 24 is separated from the other recording media 130 by the retard roller 26 and the feed roller 28, is guided into the transport path 32, is stopped temporarily by the pair of registration rollers 38, and passes through the nip between the transfer device 42 and the image carrier 44 at an appropriate timing, whereby a toner image is transferred to the recording medium 130. Then, the toner image is fixed by the fixing device 36. Eventually, the recording medium 130 having the fixed toner image is discharged from the output port 34 by the pair of discharge rollers 40 and is output to an output portion 16.

Figure 2:
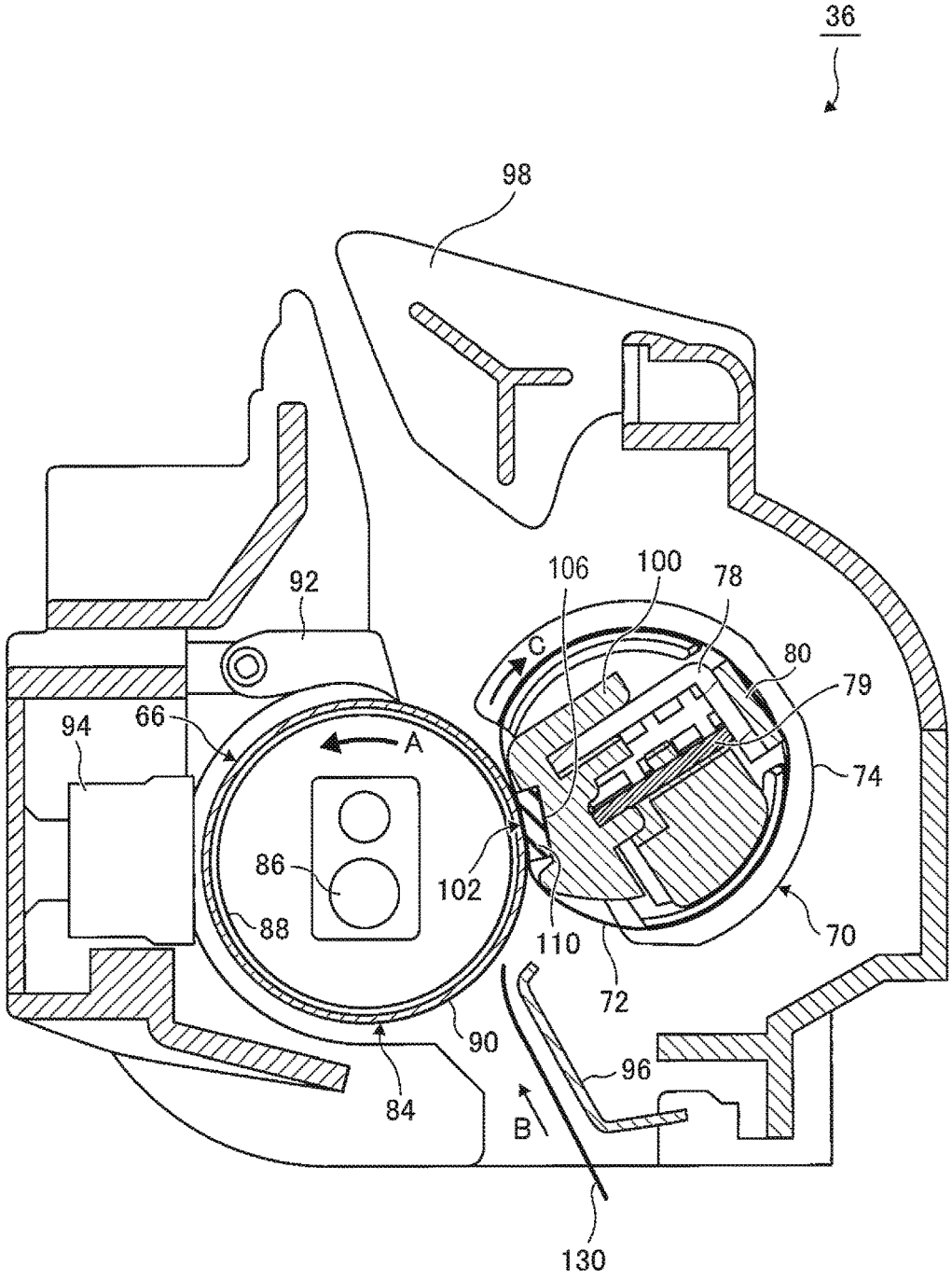
FIG. 2 is a side sectional view of a fixing device according to the exemplary embodiment.
Figure 3:
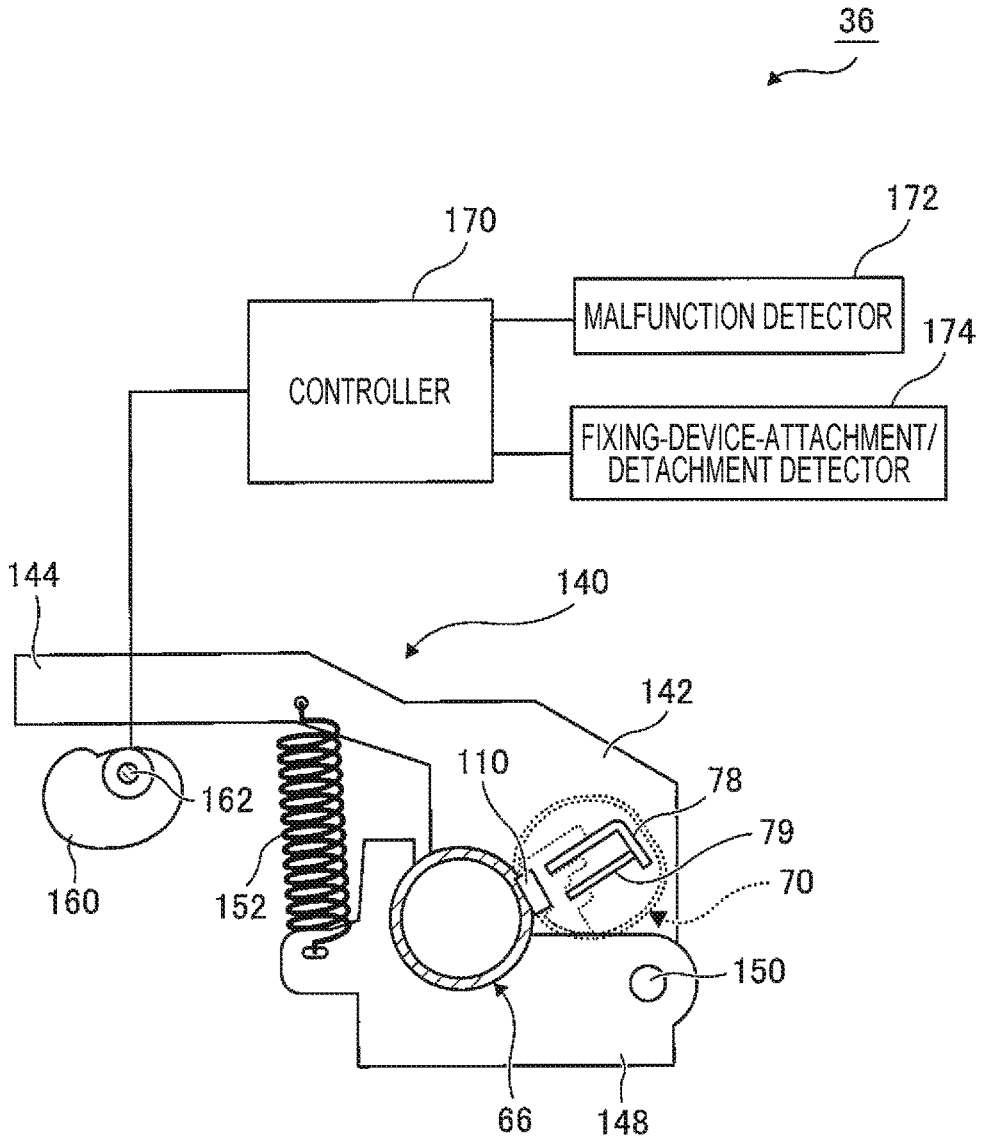
FIG. 3 is a schematic diagram illustrating the fixing device and a switching unit according to the exemplary embodiment.

Referring now to FIGS. 2 and 3, the fixing device 36 includes a heating roller 66 as a heating unit, and a pressing unit 70. The pressing unit 70 includes an endless belt 72 as an endless belt-like member, and a guide member 74 that guides the endless belt 72 such that the endless belt 72 is rotatable. The pressing unit 70 is pressed against the heating roller 66. The fixing device 36 further includes a switching unit 140 and is capable of changing the pressing force, which is applied to the heating roller 66, by moving the pressing unit 70 relative to the heating roller 66. In the present exemplary embodiment, the pressing force exerted by the pressing unit 70 of the fixing device 36 is changeable among a normal pressing force applied in a normal case, a weak pressing force weaker than the normal pressing force, and a zero pressing force in a case where the pressing force is removed. The changing of the pressing force of the fixing device 36 by the switching unit 140 is controlled by the controller 170 provided in the image-forming-apparatus body 12.

The heating roller 66 includes a cylindrical roller portion 84, and a heater 86 provided in the roller portion 84. The roller portion 84 is rotatably supported by heating-roller bearings (not illustrated) and is rotatable in a direction of arrow A (see FIG. 2). The roller portion 84 includes a core 88 made of metal such as iron, stainless steel, or aluminum, and a release layer 90 provided over the core 88. The roller portion 84 is a so-called hard roller having no elastic layer. The release layer 90 is made of an insulating material having high releasability, such as perfluoroalkoxy alkane (PFA). A releasing member 92 is provided in contact with the roller portion 84.

The heater 86 includes, for example, two lamp heaters. A thermostat 94 is provided across the heating roller 66 from the endless belt 72 in such a manner as to face the heating roller 66.

The endless belt 72 is present between the heating roller 66 and the pressing unit 70 and rotates in a direction of arrow C (see FIG. 2) by following the rotation of the heating roller 66. Since the pressing unit 70 is configured such that the endless belt 72 is pressed against the heating roller 66, a nip area 102 is provided. The toner image formed on the recording medium 130 is fixed in the nip area 102. The endless belt 72 includes a belt member made of synthetic resin such as polyimide, and a release layer made of PFA or the like provided over the belt member.

An inlet chute 96 is provided on the upstream side of the nip area 102. The recording medium 130 transported in a direction of arrow B is guided by the inlet chute 96 such that the leading end thereof is introduced into the nip area 102 (see FIG. 2). An outlet chute 98 is provided on the downstream side of the nip area 102.

As illustrated in FIG. 2, the pressing unit 70 further includes a holder 100 provided on the inner side of the endless belt 72, a pressing member 110 attached to the holder 100, and frames 78 and 79 that support the holder 100. Furthermore, an impregnated pad 80 that supplies lubricant to the endless belt 72 is provided on the inner side of the endless belt 72.

The nip area 102 provided by the pressing unit 70 pressed against the heating roller 66 is defined by the pressing member 110 attached to the holder 100. The holder 100 and the frames 78 and 79 of the pressing unit 70 cooperate to cause the pressing member 110 and the holder 100 to be pressed against the heating roller 66.

The holder 100 is made of a resin material such as liquid-crystal polymer (LCP) that is highly heat resistant. As illustrated in FIG. 2, the holder 100 has, on a side thereof facing the heating roller 66, a seating surface 106 on which the pressing member 110 that defines the nip area 102 is seated.

The pressing member 110 has substantially the same length as the holder 100 in the longitudinal direction of the holder 100. The pressing member 110 is a rectangular parallelepiped member made of a heat-resistant resin material such as silicon rubber.

The guide member 74, illustrated in FIG. 2, is provided at each of two ends of the endless belt 72 (the pressing unit 70). The pressing unit 70 is supported by the guide members 74.

As illustrated in FIG. 2, the frames 78 and 79 support the holder 100 and are each supported at two ends thereof by the respective guide members 74, whereby the holder 100 is pressed toward the heating roller 66. The ends of the frames 78 and 79 extend through the guide members 74 and are connected to a movable frame body 142 included in the switching unit 140. The frames 78 and 79 are urged toward the heating roller 66 by urging members (not illustrated) such as springs.

Referring now to FIG. 3, the switching unit 140 includes a fixed frame body 148 that supports the heating roller 66 of the fixing device 36, and the movable frame body 142 that is rotatably attached to a shaft portion 150 provided on the fixed frame body 148. The frames 78 and 79 of the pressing unit 70 are fixed to the movable frame body 142.

The movable frame body 142 and the fixed frame body 148 are connected to each other with a spring member 152 as an urging member that generates an urging force pulling the movable frame body 142 and the fixed frame body 148 toward each other.

The movable frame body 142 includes a long, narrow, stick-like arm portion 144 extending on a side thereof opposite the shaft portion 150. A flat cam 160 and a rotating shaft 162 are provided near the arm portion 144. The flat cam 160 serves as a pushing member that pushes and thus moves the arm portion 144 of the movable frame body 142. The flat cam 160 is rotated about the rotating shaft 162. The flat cam 160 has a shape defined by different distances from the center thereof to the outer periphery thereof. When the flat cam 160 is rotated about the rotating shaft 162, the arm portion 144 of the movable frame body 142 is pushed by the flat cam 160. Thus, the movable frame body 142 is moved by a length corresponding to the distance thereto from the center of the flat cam 160. That is, the length of movement of the movable frame body 142 is variable. In accordance with such variations, the pressing force of the fixing device 36 is changed. The rotation of the rotating shaft 162 is controlled by the controller 170 provided in the image-forming-apparatus body 12.

Figure 4A:
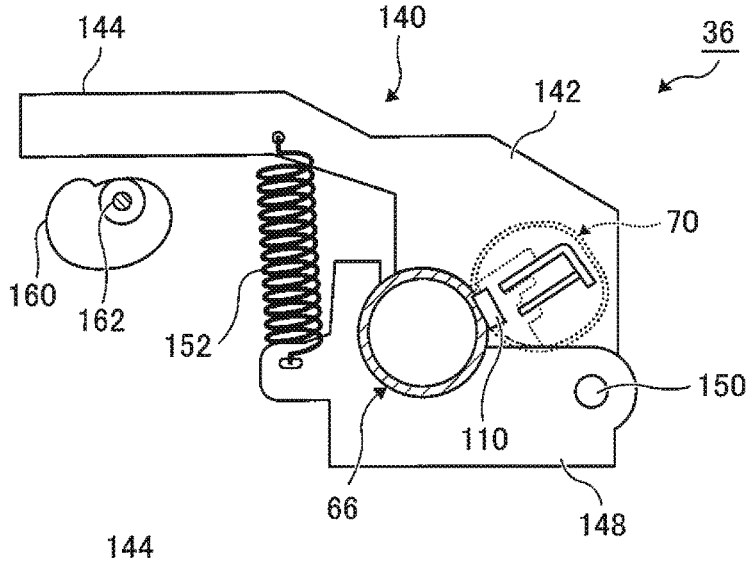
FIG. 4A is a side view of the fixing device when the switching unit is positioned such that a flat cam and a movable frame body are spaced apart from each other.

In the image forming apparatus 10 according to the present exemplary embodiment, the pressing force of the fixing device 36 is adjusted, i.e., changed, by the switching unit 140 as described above. Specifically, when a point of the flat cam 160 where the distance from the center of the flat cam 160 to the outer periphery of the flat cam 160 is shortest faces the arm portion 144 of the movable frame body 142 as illustrated in FIG. 4A, the outer periphery of the flat cam 160 is out of contact with the movable frame body 142. Hence, the arm portion 144 of the movable frame body 142 is not pushed by the flat cam 160. Therefore, the movable frame body 142 is pulled by the spring member 152 toward the fixed frame body 148 in such a manner as to rotate about the shaft portion 150. Thus, the pressing unit 70 connected to the movable frame body 142 and to the frames 78 and 79 is pressed against the heating roller 66. The pressing force generated in this state is regarded as, for example, a pressing force for normal printing. Note that the point of the flat cam 160 that faces the arm portion 144 of the movable frame body 142 is not limited to the point of the flat cam 160 where the distance from the center to the outer periphery is shortest and only needs to be a point where the flat cam 160 does not push the arm portion 144 of the movable frame body 142 or where a gap is produced between the flat cam 160 and the arm portion 144 of the movable frame body 142.

Figure 4B:
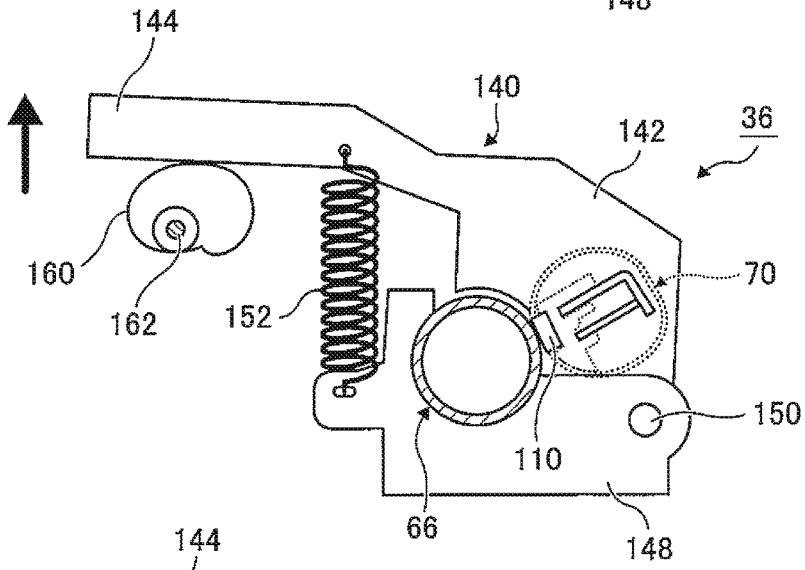
FIG. 4B is a side view of the fixing device when the switching unit is positioned such that the flat cam pushes the movable frame body with a force weaker than a normal force.
Figure 4C:
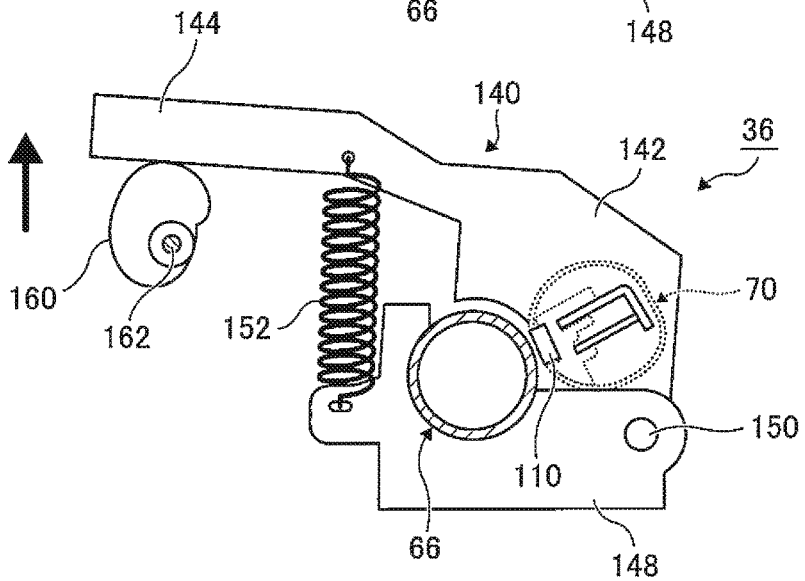
FIG. 4C is a side view of the fixing device when the switching unit is positioned such that the flat cam pushes the movable frame body with the normal force.
Figure 5:
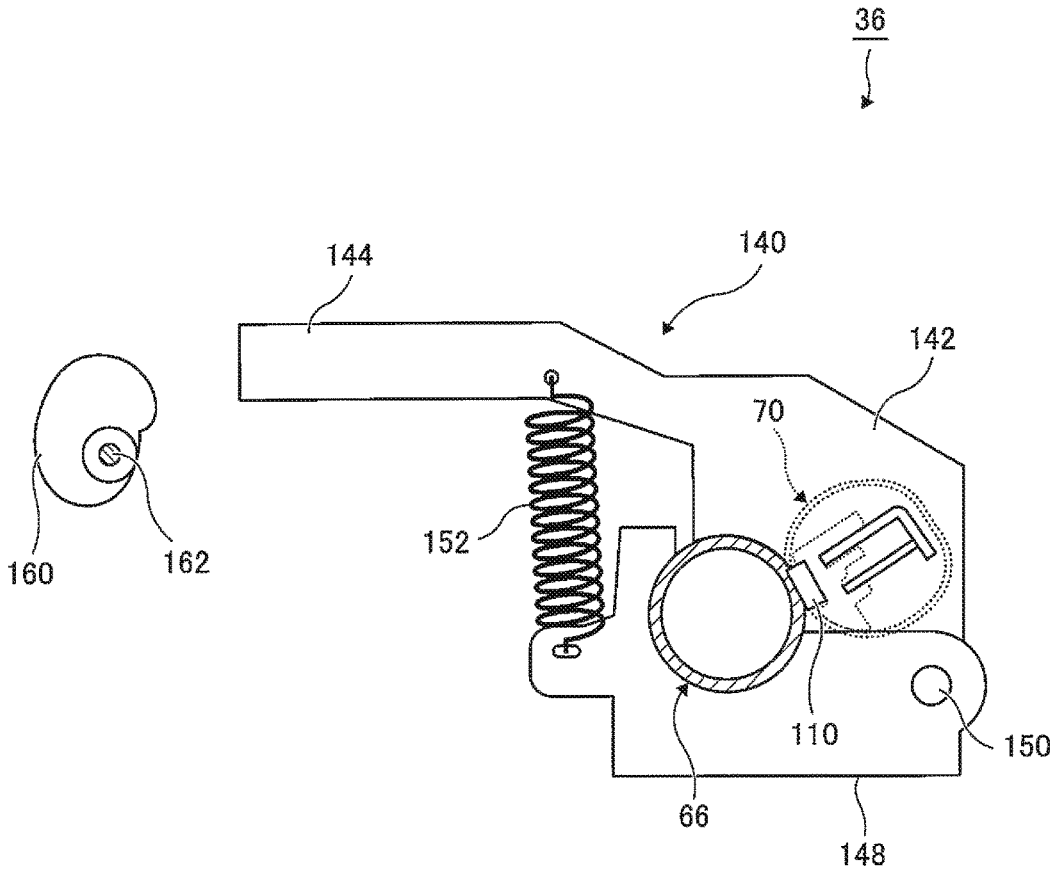
FIG. 5 is a side view of the fixing device that is about to be attached to an image-forming-apparatus body, with the flat cam of the switching unit being at the position for pushing the movable frame body.
Figure 6:
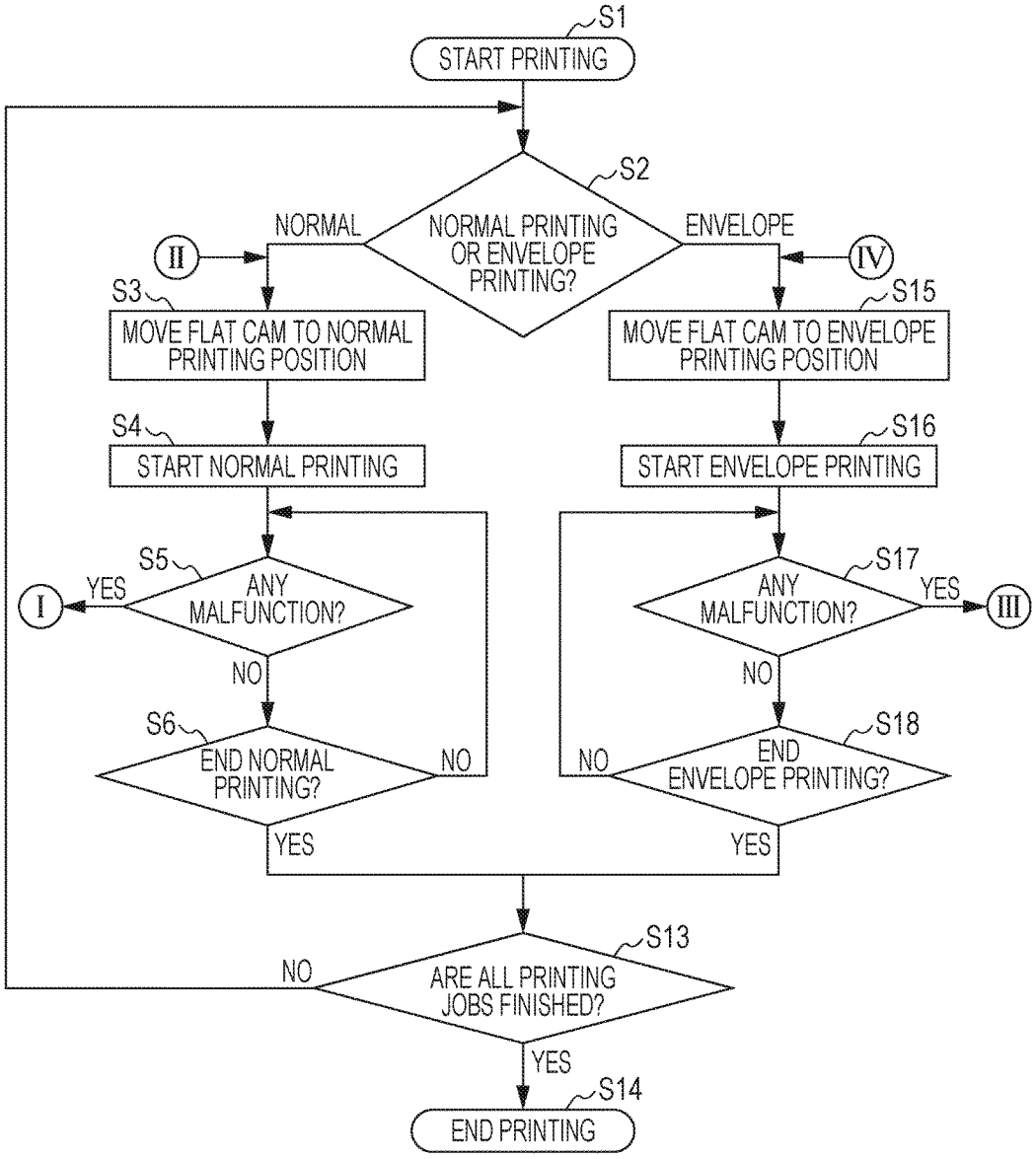
FIG. 6 is a flow chart illustrating a printing process according to the exemplary embodiment.
Figure 7A:
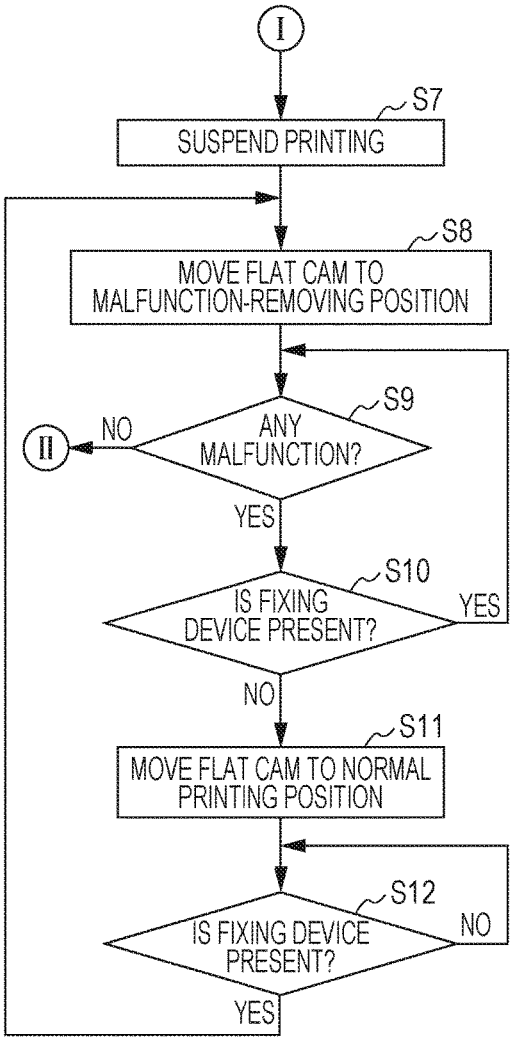
FIGS. 7A and 7B are each a flow chart illustrating a part of the flow chart illustrated in FIG. 6.
Figure 7B:
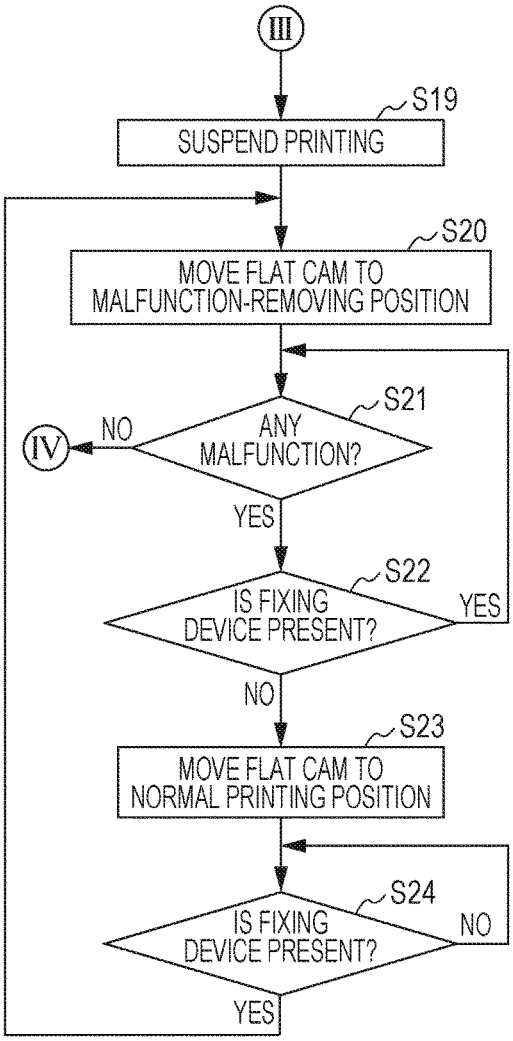

When a point of the flat cam 160 where the distance from the center to the outer periphery is longest faces the movable frame body 142 as illustrated in FIG. 4C, the arm portion 144 of the movable frame body 142 is pushed by the outer periphery of the flat cam 160. Hence, the movable frame body 142 is moved such that the pressing unit 70 and the heating roller 66 are spaced apart from each other against the urging force exerted by the spring member 152. That is, no force of pressing the pressing unit 70 against the heating roller 66 is generated. Such a state where no pressing force is generated is established if a predetermined gap needs to be provided between the pressing unit 70 and the heating roller 66 so that a malfunction, if any occurs, is easily removed. Exemplary malfunctions include a situation where a recording medium 130 jammed in the image-forming-apparatus body 12 needs to be removed, or a situation where the covering member 13 of the image-forming-apparatus body 12 is opened.

When a point of the flat cam 160 between the two points where the distance from the center to the outer periphery is shortest and longest faces the arm portion 144 of the movable frame body 142 as illustrated in FIG. 4B, the movable frame body 142 is pushed and moved by the outer periphery of the flat cam 160. However, the length of movement of the movable frame body 142 is shorter than that in the case where the force for normal printing is applied from the pressing unit 70 to the heating roller 66. Therefore, the pressing force of the pressing unit 70 applied to the heating roller 66 is weaker than the pressing force for normal printing. Such a pressing force weaker than the normal pressing force is used in, for example, performing printing on an envelope.

The flat cam 160 and the rotating shaft 162 are provided on the image-forming-apparatus body 12. Therefore, even if the fixing device 36 is detached from the image-forming-apparatus body 12, the flat cam 160 and the rotating shaft 162 remain in the image-forming-apparatus body 12. The flat cam 160 and the rotating shaft 162 are rotated by a driving device (not illustrated), such as a motor, controlled by the controller 170 of the image forming apparatus 10.

In the image forming apparatus 10 according to the present exemplary embodiment, the controller 170 changes the pressing force of the fixing device 36 by rotating the rotating shaft 162 and thus the flat cam 160 in accordance with signals transmitted thereto from a malfunction detector 172 and a fixing-device-attachment/detachment detector 174 to be described later.

Referring basically to FIGS. 4A to 4C, 6, and 7A and 7B, a printing process performed by the image forming apparatus 10 according to the present exemplary embodiment will now be described along with an operation of controlling the switching unit 140. Note that the image forming apparatus 10 according to the present exemplary embodiment is capable of performing normal printing and envelope printing.

When a printing process of the image forming apparatus 10 according to the present exemplary embodiment is started (step S1), the image forming apparatus 10 checks whether the current printing job is for normal printing or for envelope printing (step S2). This step may be performed by, for example, the user before the printing process is started or by using a sensor or the like that detects the type of the recording medium 130.

A process of normal printing will first be described. If it is determined that normal printing is to be performed (if NORMAL in step S2), the flat cam 160 of the switching unit 140 is rotated such that the pressing unit 70 of the fixing device 36 applies the pressing force for normal printing to the heating roller 66 (step S3). In this step, the flat cam 160 is positioned such that the point where the distance from the center to the outer periphery is shortest faces the arm portion 144 of the movable frame body 142, that is, the movable frame body 142 is not pushed by the flat cam 160 (see FIG. 4A).

After the pressing force of the fixing device 36 is adjusted for normal printing by the switching unit 140, a normal printing job is started (step S4).

While the normal printing job is being performed, the malfunction detector 172 keeps detecting any malfunction of the fixing device 36 and checks whether or not there is any malfunction occurring in the fixing device 36 (step S5). Exemplary malfunctions detected during the printing process include jamming of the recording medium 130, or the opening of the covering member 13 of the image-forming-apparatus body 12. That is, the malfunction is regarded as a situation where the fixing device 36 has become incapable of performing or difficult to perform the normal operation. The detection of any malfunction is performed by, for example, receiving a signal from a sensor or the like provided to the fixing device 36, the covering member 13, or any other associated element.

If no malfunction of the fixing device 36 is recognized while the normal printing job is performed (NO in step S5), it is checked whether or not the current normal printing job is finished (step S6). If the current normal printing job is not finished (NO in step S6), the detection of any malfunction is continued (step S5) until the normal printing job ends.

On the other hand, if any malfunction of the fixing device 36 is recognized while the normal printing job is performed (YES in step S5), the printing job is suspended (step S7). In this step, the occurrence of a malfunction in the fixing device 36 is notified by means of a sound, a screen display (not illustrated), or the like.

After the normal printing job is suspended, the flat cam 160 of the switching unit 140 is rotated such that the point where the distance from the center to the outer periphery is longest pushes the arm portion 144 of the movable frame body 142. Thus, the pressing force applied to the heating roller 66 by the pressing unit 70 of the fixing device 36 is removed (step S8). That is, since the above rotation of the flat cam 160 pushes the movable frame body 142, a gap is produced between the pressing unit 70 and the heating roller 66, whereby a state where no pressing force is generated is established (see FIG. 4C).

Subsequently, the detection of any malfunction of the fixing device 36 is performed by the malfunction detector 172 (step S9). If no malfunction of the fixing device 36 is recognized (NO in step S9), the normal printing job is restarted. In that case, as described above, the flat cam 160 of the switching unit 140 is rotated again such that the pressing unit 70 of the fixing device 36 is pressed against the heating roller 66 with the pressing force for normal printing (step S3).

On the other hand, if any malfunction of the fixing device 36 is recognized and it is determined that the malfunction of the fixing device 36 is yet to be removed (YES in step S9), the fixing-device-attachment/detachment detector 174 detects the presence of the fixing device 36 (step S10) so as to check whether or not the fixing device 36 has been detached from the image-forming-apparatus body 12. If the presence of the fixing device 36 is recognized (YES in step S10) and it is determined that the fixing device 36 remains in the image-forming-apparatus body 12, the detection of any malfunction of the fixing device 36 is continued (step S9) until the malfunction is removed.

If the presence of the fixing device 36 is not recognized (NO instep S10) and it is determined that the fixing device 36 has been detached from the image-forming-apparatus body 12, the pressing unit 70 of the fixing device 36 is pressed against the heating roller 66. That is, the flat cam 160 of the switching unit 140 is rotated such that the point where the distance from the center to the outer periphery is shortest faces the arm portion 144 of the movable frame body 142. Thus, the flat cam 160 and the movable frame body 142 are spaced apart from each other, whereby the pressing force for normal printing is generated (step S11, see FIG. 4A).

In this step, even if any malfunction of the fixing device 36 is recognized and the flat cam 160 stays at the position for pushing the movable frame body 142, the fixing device 36 is detachable from the image-forming-apparatus body 12. However, when the fixing device 36 is reattached to the image-forming-apparatus body 12, the movable frame body 142 that has returned to the initial position under the urging force exerted by the spring member 152 interferes with the flat cam 160 provided in the image-forming-apparatus body 12 (see FIG. 5).

Hence, the flat cam 160 is rotated in advance to the position where the pressing force for normal printing is generated. Thus, a gap is produced between the flat cam 160 and the movable frame body 142.

Subsequently, the presence of the fixing device 36 is detected by the fixing-device-attachment/detachment detector 174 (step S12), and it is checked whether or not the fixing device 36 has been attached to the image-forming-apparatus body 12. If the presence of the fixing device 36 is not recognized (NO in step S12) and it is determined that the fixing device 36 is still out of the image-forming-apparatus body 12, the presence of the fixing device 36 continues to be detected until it is determined that the fixing device 36 has been attached to the image-forming-apparatus body 12.

On the other hand, if the presence of the fixing device 36 is recognized (YES in step S12) and it is determined that the fixing device 36 has been attached to the image-forming-apparatus body 12, the flat cam 160 of the switching unit 140 is rotated again from the position for normal printing to the position taken when the malfunction has been recognized, that is, the flat cam 160 is rotated such that the point where the distance from the center to the outer periphery is longest pushes the movable frame body 142 (step S8, see FIG. 4C) so that the pressing unit 70 and the heating roller 66 are spaced apart from each other. Then, the detection of any malfunction of the fixing device 36 is performed by the malfunction detector 172 again (step S9).

Subsequently, the detection of any malfunction of the fixing device 36 by the malfunction detector 172 is continued until the malfunction of the fixing device 36 is removed. Then, if no more malfunction of the fixing device 36 is recognized (NO in step S9), the normal printing job is restarted, as described above (step S3 and thereafter, see FIG. 4A).

If the current normal printing job is finished (YES in step S6), it is checked whether or not all printing jobs are finished (step S13). If all printing jobs are not finished (NO in step S13), the printing process is continued. In that case, it is checked whether the subsequent printing job is for normal printing or for envelope printing (step S2).

If all printing jobs are finished (YES in step S13), the whole printing process ends (step S14).

Now, a process of envelope printing will be described. Redundant description of the steps that are common to those for the process of normal printing is omitted.

If it is determined that envelope printing is to be performed (if ENVELOPE in step S2), the flat cam 160 of the switching unit 140 is rotated such that the pressing unit 70 of the fixing device 36 is pressed against the heating roller 66 with the pressing force weaker than the pressing force for normal printing (step S15). In this step, the flat cam 160 is positioned such that the point between the two points where the distance from the center to the outer periphery is shortest and longest pushes the arm portion 144 of the movable frame body 142 (see FIG. 4B).

After the pressing force of the fixing device 36 is adjusted for envelope printing by the switching unit 140, an envelope printing job is started (step S16).

While the envelope printing job is being performed, the malfunction detector 172 keeps detecting any malfunction of the fixing device 36 and checks whether or not there is any malfunction occurring in the fixing device 36 (step S17), as with the case of normal printing.

If no malfunction of the fixing device 36 is recognized while the envelope printing job is performed (NO in step S17), it is checked whether or not the current envelope printing job is finished (step S18). If the current envelope printing job is not finished (NO in step S18), the detection of any malfunction of the fixing device 36 is continued (step S17) until the envelope printing job is finished.

On the other hand, if any malfunction of the fixing device 36 is recognized while the envelope printing job is performed (YES in step S17), the printing job is suspended (step S19).

After the envelope printing job is suspended, the pressing force applied to the heating roller 66 by the pressing unit 70 of the fixing device 36 is removed, as with the case of normal printing. That is, the flat cam 160 of the switching unit 140 is rotated such that the point where the distance from the center to the outer periphery is longest pushes the arm portion 144 of the movable frame body 142 (step S20, see FIG. 4C).

If no malfunction of the fixing device 36 is recognized (NO in step S21) as a result of detection by the malfunction detector 172 (step S21) and if it is determined that the malfunction of the fixing device 36 has been removed, the envelope printing job is restarted. In that case, as described above, the flat cam 160 of the switching unit 140 is rotated again such that the pressing unit 70 of the fixing device 36 is pressed against the heating roller 66 with the pressing force for envelope printing (step S15).

On the other hand, if any malfunction of the fixing device 36 is recognized (YES in step S21) and it is determined that the malfunction of the fixing device 36 is yet to be removed, the fixing-device-attachment/detachment detector 174 detects the presence of the fixing device 36 (step S22), as with the case of normal printing, so as to determine whether or not the fixing device 36 has been detached from the image-forming-apparatus body 12. If the presence of the fixing device 36 is recognized (YES in step S22) and it is determined that the fixing device 36 remains in the image-forming-apparatus body 12, the checking of whether or not the malfunction of the fixing device 36 has been removed is continued (step S21).

If the presence of the fixing device 36 is not recognized (NO in step S22) and it is determined that the fixing device 36 has been detached from the image-forming-apparatus body 12, the flat cam 160 of the switching unit 140 is rotated such that the point where the distance from the center to the outer periphery is shortest faces the arm portion 144 of the movable frame body 142, whereby the pressing force for normal printing is generated (step S23, see FIG. 4A).

Positioning the flat cam 160 such that the pressing force is adjusted for normal printing produces a gap between the flat cam 160 and the movable frame body 142.

Subsequently, the presence of the fixing device 36 is detected by the fixing-device-attachment/detachment detector 174 (step S24), and it is checked whether or not the fixing device 36 has been attached to the image-forming-apparatus body 12. If the presence of the fixing device 36 is not recognized (NO in step S24) and it is determined that the fixing device 36 is still out of the image-forming-apparatus body 12, the presence of the fixing device 36 continues to be detected until it is determined that the fixing device 36 has been attached to the image-forming-apparatus body 12.

On the other hand, if the presence of the fixing device 36 is recognized (YES in step S24) and it is determined that the fixing device 36 has been attached to the image-forming-apparatus body 12, the flat cam 160 of the switching unit 140 is rotated again from the position for normal printing to the position for removing the malfunction, that is, the flat cam 160 is rotated such that the point where the distance from the center to the outer periphery is longest pushes the movable frame body 142 (step S20, see FIG. 4C). Then, the detection of any malfunction of the fixing device 36 is performed by the malfunction detector 172 again (step S21).

Subsequently, the detection of any malfunction of the fixing device 36 by the malfunction detector 172 is continued until the malfunction is removed. Then, if no more malfunction of the fixing device 36 is recognized (NO in step S21), the envelope printing job is restarted, as described above (step S15 and thereafter, see FIG. 4B).

If the current envelope printing job is finished (YES in step S18), it is checked whether or not all printing jobs are finished (step S13). If all printing jobs are not finished, the printing process is continued (NO in step S13). In that case, it is checked whether the subsequent printing job is for normal printing or for envelope printing (step S2).

Subsequently, if all printing jobs are finished (YES in step S13), the whole printing process ends (step S14).

This is the end of the whole printing process performed by the image forming apparatus 10 according to the present exemplary embodiment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a fixing device that includes a pressing unit, and a heating unit provided facing the pressing unit;

an image-forming-apparatus body in which the fixing device is housed and to and from which the fixing device is attachable and detachable, the image forming-apparatus body including an actuator for controlling a position of the pressing unit with respect to the heating unit;

a fixing-device-attachment-detachment-detecting member that detects attachment or detachment of the fixing device to or from the image-forming-apparatus body; and a controller that controls, in response to the fixing-device-attachment-detachment-detecting member detecting the detachment of the fixing device from the image-forming-apparatus body, the actuator to move to a position where the pressing unit and the heating unit are to be pressed against each other during a time when the fixing device is detached from the image-forming-apparatus body and while attaching the fixing device to the image-forming-apparatus body.

2. The image forming apparatus according to claim 1, further comprising:

a malfunction detecting member that detects any malfunction of the fixing device, wherein, if any malfunction of the fixing device is detected by the malfunction detecting member, the controller controls the pressing unit and the heating unit to be spaced apart from each other using the actuator, and wherein, if the fixing-device-attachment-detachment-detecting member detects the detachment of the fixing device from the image-forming-apparatus body in a state where any malfunction of the fixing device is detected, the controller controls the actuator to move to a position where the pressing unit and the heating unit are to be pressed against each other during the time when the fixing device is detached from the image-forming-apparatus body and while attaching the fixing device to the image-forming-apparatus body.

3. The image forming apparatus according to claim 2, wherein the image-forming-apparatus body has a covering member that is opened or closed when the fixing device is attached to or detached from the image-forming-apparatus body, and wherein a state where the covering member is open or a state where the fixing device is incapable of performing normal operation, is detected as a malfunction by the malfunction detecting member.

4. The image forming apparatus according to claim 1, wherein the controller is controls the pressing unit and the heating unit to be pressed against each other, when attached to the image-forming apparatus body, with a force that is weaker than a force with which the pressing unit and the heating unit are pressed against each other in a state where the fixing device is detached from the image-forming-apparatus body.

5. The image forming apparatus according to claim 1, further comprising:

a switching device that includes a fixed frame body provided on the fixing device and to which one of the pressing unit and the heating unit is attached;

a movable frame body that is movable relative to the fixed frame body and to which another one of the pressing unit and the heating unit is attached; and an urging member attached to the fixed frame body and to the movable frame body and that exerts an urging force that moves the pressing unit and the heating unit toward each other, wherein the actuator is a pushing member provided on the image-forming-apparatus body and that is controlled by the controller in such a manner as to be movable between a position where the pushing member pushes the movable frame body and a position where the pushing member is spaced apart from the movable frame body, wherein, when the movable frame body is moved in accordance with the movement of the pushing member, a force of pressing the pressing unit and the heating unit against each other is changed.

6. The image forming apparatus according to claim 5, wherein the switching device operates such that to generate the force of pressing the pressing unit and the heating unit against each other, the pushing member is spaced apart from the movable frame body, and the pressing unit and the heating unit are brought into contact with each other under the urging force exerted by the urging member; and to remove the force of pressing the pressing unit and the heating unit against each other, the pushing member pushes the movable frame body against the urging force exerted by the urging member and moves the pressing unit and the heating unit away from each other.

7. The image forming apparatus according to claim 5, wherein the pushing member is a plate member in which a distance from a center to an outer periphery is inconstant, and wherein, when the pushing member is rotated about an axis, the pushing member is moved between the position where the outer periphery of the pushing member pushes the movable frame body and the position where the pushing member is spaced apart from the movable frame body.

* * * * *